United States Patent [19]

Pollock

[11] 4,445,442

[45] May 1, 1984

[54] FURNACE CONSTRUCTION HAVING AN ASH PIT WITH A RADIATION REFLECTING SURFACE

[75] Inventor: William H. Pollock, East Granby, Conn.

[73] Assignee: Combustion Engineering, Inc., Windsor, Conn.

[21] Appl. No.: 435,782

[22] Filed: Oct. 21, 1982

[51] Int. Cl.[3] ..... F23J 1/02

[52] U.S. Cl. ..... 110/171; 110/165 R

[58] Field of Search ..... 110/165 R, 165 A, 166, 110/171

[56] References Cited

U.S. PATENT DOCUMENTS 1,863,218 6/1932 Allen ..... 110/171

1,866,404 7/1932 Frisch et al. ..... 110/165 R 4,301,747 11/1981 Lockwood, Jr. et al. ..... 110/171

FOREIGN PATENT DOCUMENTS 608050 1/1935 Fed. Rep. of Germany ..... 110/171

*Primary Examiner*—Edward G. Favors

*Assistant Examiner*—Steven E. Warner

*Attorney, Agent, or Firm*—Arthur L. Wade

[57] ABSTRACT

A water-wall, coal-fired furnace has a Coutant transition section extending down from the lower end to the water wall to the surface of water impounded in the lower ash hopper. The surface of the water is provided with a reflecting material which will permit the passage of solid residue from the coal firing into the water while reflecting incident radiant heat back up into the generating section of the furnace.

2 Claims, 2 Drawing Figures

FURNACE CONSTRUCTION HAVING AN ASH PIT WITH A RADIATION REFLECTING SURFACE

TECHNICAL FIELD

Figure 1:
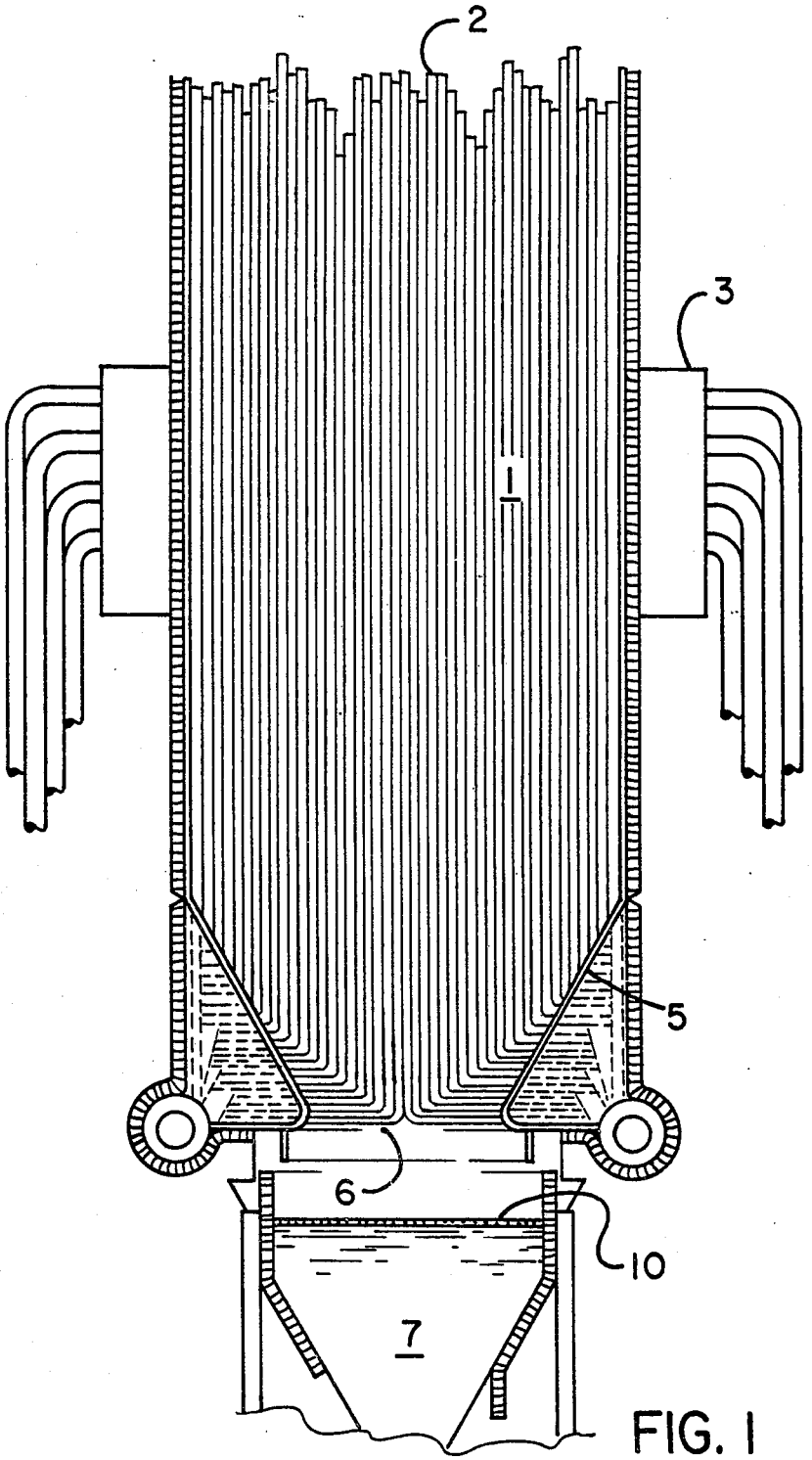

The present invention relates to the conservation of heat in the lower portion of a coal-fired furnace. The invention further relates to conserving heat by reflecting the incident radiant heat from the bottom of a coal-fired furnace back up into the lower portion of its steam-generating section.

BACKGROUND ART

Within the overall energy problems facing this country, intense planning is centered around the coal-fired furnaces and oil and gas-fired furnaces which can be retrofitted to burn coal. The coal-fired furnaces utilize a Coutant transition section on the bottom to cool and concentrate the solid residue from the combustion of coal. Essentially, the Coutant transition section is a funnel with sides sloped at 50° to 60° from the horizontal, narrowing to a slot in the order of 2' to 4' wide. Below the slot, a body of water is impounded in the ash hopper which receives the hot, solid fuel residue where it is collected and from which it is subsequently removed.

Although the tubes comprising the water walls are extended down the sides of the Coutant transition section, the volume of the section is below the level of the furnace volume in which the coal is burning and represents a wastage of the combustion chamber volume. The incident radiant heat of the combustion above the section is projected downward into the impounded water below and is not utilized to generate steam.

In retrofitting an oil or gas-fired furnace for burning coal, the inherent losses represented by the Coutant transition section are inherited by the retrofitted furnace. It is desirable in both the originally-designed coal-fired furnace and any retrofitted oil or gas furnaces to reduce the volume of the Coutant transition section to make more efficient use of the combustion chamber volume.

In restatement, currently one of the major problems created when converting large top supported vertical furnace industrial and utility oil and gas-fired boilers to coal, is the tremendous loss in furnace volume that occurs when a conventional Coutant hopper bottom is added for ash removal with coal firing. The reduced furnace volume in this case is generally the limiting factor in determining the maximum boiler capacity in the new coal-firing mode. A structure is desired which will improve the originally designed coal-fired furnaces, as well as the converted oil and gas-fired furnaces, and allow a higher boiler capacity to be obtained when the furnace volume is the limiting factor.

In addition, the structure is expected to be effective in existing ash hoppers to reduce the wasted heat of the incident radiation from the furnace being absorbed by and heating the waste water in the ash hopper. It is sought to significantly reduce, or eliminate, the ash hopper water cooling and recirculation system used to maintain the ash hopper water temperature below the boiling point.

DISCLOSURE OF THE INVENTION

The present invention contemplates providing a material for the surface of the impounded water of an ash hopper beneath the Coutant transition section of a coal-fired furnace which will reflect incident radiant heat of the combustion back up into the steam generating section of the furnace.

The invention further contemplates the reflecting material on the upper surface of the body of water of the ash hopper will permit passage of the solid residue of coal firing into the body of water without substantial loss of the reflective material from the surface of the body of water.

Other objects, advantages and features of this invention will become apparent to one skilled in the art upon consideration of the written specification, appended claims, and attached drawings.

BRIEF DESIGNATION OF THE DRAWINGS

Figure 2:
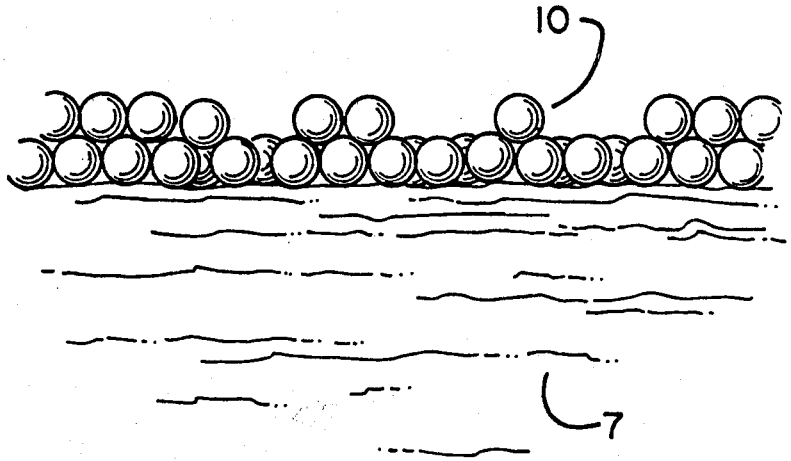

FIG. 1 is a sectioned elevation of the lower portion of a coal-fired furnace having a water-impounded ash hopper provided with a surface material embodying the present invention; and FIG. 2 is a sectioned elevation of the hollow metallic balls acting as a reflective surface.

BEST MODE FOR CARRYING OUT THE INVENTION

Terms and Technology

It is not necessary to catalogue the various terms and discuss the technology associated with conventional coal, gas, and oil-fired furnaces. These items are too well-known to need discussion in order to disclose the invention. The water walls of a furnace, its burner system for developing a zone of combustion within the water walls, and the general form of a dry bottom Coutant transition section to control the collection of solid residue from coal firing are all familair arrangements of this art. However, it must be understood that there is a body of water impounded below the lower opening of these Coutant transition sections to receive the continuously developed, hot, solid residue from the combustion of solid fuel above the transition section. The lower opening of this transition section is a slot which is as narrow as possible to direct the descending residue in a tight concentration within the body of impounded water so that this material may be periodically of continuously raked to a point in a chain of disposal equipment.

Exposed to the incident radiation of the combustion within the furnace, this water is raised in temperature by this waste heat. A cooling system must be provided to prevent this body of water from boiling. The present invention greatly reduces the temperature of this impounded water and, correspondingly, the load on the cooling system required for this water. The invention is embodied in a means with which this incident radiation is turned back, up into the furnace above the transition section and applied to the useful generation of steam as water is passed through the tubes of the water walls. With the invention effective, the narrow slot of the transition section can be enlarged and the height of the transition section reduced to permit extending the full width of the water walls and burners downward, thereby increasing the effective furnace volume for combustion.

Furnace Bottom Arrangement

FIG. 1 discloses only the lower portion of a utility furnace, or boiler. The combustion chamber 1 is a volume within the furnace defined within the water walls 2. A burner 3 is shown in just enough detail to depict its generation of combustion of solid fuel in chamber 1. The resulting transmission of heat by convection and radiation to the water within the walls 2 is well-known and needs no further discussion.

The furnace is either originally designed as a coal-fired unit, or has been modified into a coal-fired unit from an oil or gas-fired unit. In either event, it is the combustion of solid fuel which produces the solid residue which descends to the bottom and must be guided by the funnel shape of transition section 5. Transition section 5 terminates downwardly in opening 6. Directly below opening 6 is an impounded body of water 7. Of course, the solid residue from the combustion is guided by the sloping walls of transition section 5 to fall into the relatively small area below opening 6. Thus, collected, the accumulated solid residue is continuously, or periodically, removed by a system not necessary to disclose.

The Invention

A material is provided for the surface of the impounded body of water 7 which will be maintained at the surface and function to reflect the incident radiation upward. A proper selection of material 10 will effectively reflect a significant amount of the incident radiation which would otherwise be wasted in heating the body of water 7. This material must be maintained at the surface of the water and permit the passage of solid residue into the body of water. Further, a significant portion of the material must not be captured or entrained by the solid material and carried out with it.

The essential material 10, embodying the present invention, has a specific gravity less than 1. In other words, the material must float on the surface of the body of water 7, and, of course, the material must reflect a satisfactory percentage of the incident radiation which it receives.

I have determined that the preferred form of this material can be fabricated as hollow metallic balls, such as aluminum. A collection of sufficiently small metallic balls, such as aluminum, can be readily penetrated by the solid residue, yet form an effective reflecting surface for the incident radiation. It is conceivable that fluids with a specific gravity of less than 1 and a capability of reflecting the incident radiation, can be provided for this purpose. However, a body 10 made up of small metallic balls, such as aluminum, will form the reflective surface, float on the surface of body 7, and satisfactorily pass the solid residue into the body 7. FIG. 2 is an enlarged portion of the reflecting material 10 as it is positioned at the surface of water body 7.

Conclusion

The immediate influence of this invention on the design of coal-fired furnaces is that the dry bottoms of these furnaces can be reduced in height. No longer does the exit from the funnel-shaped Coutant transition sections have to be narrowed to 2′ to 4′. Heretofore, the reduction of the area of the lower impounded body of water was necessary to limit the waste of incident radiation from the combustion zone above. Now, with an effective reflecting surface, the material covering the impounded body of water can be exposed to a greater extent. The incident radiation reflects back into the combustion zone. No specific figures need be collected on the quantity of this incident radiation effectively reflected to appreciate the utility of the invention. The simplicity of the invention is evident and its results in elevating the efficiency of heat driven through the walls of the tubes to generate steam is significant. All the invention demands of its embodiment is a heat-reflecting material maintained over the surface of the impounded body of water which will provide passage for the solid residue raining down from the upper furnace.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A solid fuel-burning furnace, including,
water walls forming a generating section,
at least one burner mounted through the water walls and arranged to sustain combustion of fuel and air in the generating section,
sloping sides depending from the generating section forming a Coutant transition section below the generating section to receive the residue from the combustion and terminating in a lower exit slot,
an ash pit mounted below the exit slot,
a body of water impounded in the ash pit with its surface below the exit slot,
and a plurality of hollow metallic balls having a specific gravity of less than 1 disposed in a layer over the surface of the impounded water providing a reflecting surface which will reflect incident radiation from the generating section back up into the generating section while permitting the passage of solid residue falling from the slot of the transition section into the body of impounded water.

2. The furnace of claim 1, wherein,
the metallic balls are aluminum.

* * * * *